US009625159B2

(12) United States Patent
Quintaba' et al.

(10) Patent No.: US 9,625,159 B2
(45) Date of Patent: Apr. 18, 2017

(54) GAS BURNER WITH INWARD FACING FLAME

(71) Applicant: SOMIPRESS—SOCIETA' METALLI INIETTATI S.P.A., Castelfidardo (IT)

(72) Inventors: Andrea Quintaba', Recanati (IT); Andrea Mandolesi, Falconara Marittima (IT); Paolo Serenellini, Castelfidardo (IT); Gianluca Giorgetti, Porto Recanati (IT)

(73) Assignee: SOMIPRESS—SOCIETA'METALLI INIETTATI S.P.A., Castelfidardo (IT)

( * ) Notice: Subject to any disclaimer, the term of this patent is extended or adjusted under 35 U.S.C. 154(b) by 356 days.

(21) Appl. No.: 14/354,383

(22) PCT Filed: Nov. 2, 2012

(86) PCT No.: PCT/EP2012/071752

§ 371 (c)(1),
(2) Date: Apr. 25, 2014

(87) PCT Pub. No.: WO2013/064657

PCT Pub. Date: May 10, 2013

(65) Prior Publication Data

US 2014/0318528 A1 Oct. 30, 2014

(30) Foreign Application Priority Data

Nov. 4, 2011 (IT) ..... AN2011A0151

(51) Int. Cl.
*F24C 3/08* (2006.01)
*F23D 14/08* (2006.01)

(52) U.S. Cl.
CPC ..... *F24C 3/08* (2013.01); *F23D 14/08* (2013.01); *F23D 14/085* (2013.01)

(58) Field of Classification Search
CPC ..... F23D 14/085; F23D 14/08; F24C 3/08
(Continued)

(56) References Cited

U.S. PATENT DOCUMENTS 5,704,777 A * 1/1998 Measom ..... F23D 14/145 126/39 J
6,619,280 B1 * 9/2003 Zhou ..... F23D 14/085 126/39 R (Continued)

FOREIGN PATENT DOCUMENTS

EP 0634608 A2 1/1995
EP 2090826 A1 8/2009

(Continued)

OTHER PUBLICATIONS

International Search Report for corresponding International Application No. PCT/EP2012/071752.

*Primary Examiner* — Avinash Savani
*Assistant Examiner* — Rabeeul Zuberi
(74) *Attorney, Agent, or Firm* — Egbert Law Offices, PLLC

(57) ABSTRACT

A gas burner with inward-facing flames has a base body disposed under a cooktop and a discoid lid disposed onto the base body. The base body has a central chamber connected to a horizontal Venturi tube fed by a gas injector. A peripheral annular chamber and partitions-defining apertures provide communication between the central chamber and the peripheral annular chamber. The lid has a central dish disposed onto the central chamber of the base body, an intermediate toroidal portion disposed onto the partitions of the base body, and a flame ring disposed onto the peripheral annular chamber for propagation of flame inwards.

10 Claims, 7 Drawing Sheets

(58) Field of Classification Search
USPC ..... 126/39 E, 39 R, 9 R; 431/347
See application file for complete search history.

(56) References Cited

U.S. PATENT DOCUMENTS

| | | | | |
|---|---|---|---|---|
| 6,889,685 | B2 * | 5/2005 | Dane | F23D 14/06 126/39 B |
| 2008/0210216 | A1 * | 9/2008 | Rossi | F23D 14/065 126/39 E |
| 2008/0241777 | A1 * | 10/2008 | Rossi | F23D 14/06 431/354 |
| 2009/0087804 | A1 * | 4/2009 | Pryor | F23D 14/06 431/350 |

FOREIGN PATENT DOCUMENTS

| | | | |
|---|---|---|---|
| WO | 2007078126 | A1 | 7/2007 |
| WO | 2008104831 | A1 | 9/2008 |
| WO | 2011128821 | A1 | 10/2011 |

* cited by examiner

GAS BURNER WITH INWARD FACING FLAME

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present patent application for industrial invention relates to a gas burner with flame facing inwards, namely towards the vertical axis of the burner.

2. Description of Related Art Including Information Disclosed Under 37 CFR 1.97 and 37 CFR 1.98.

Gas burners with outward-facing flame are commonly known on the market. However, these gas burners are impaired by low efficiency.

Gas burners with inward-facing flame are known in order to improve efficiency. W02006/077086 discloses a gas burner presenting two injectors and one toroidal flame divider where a first ring of ports for outward-facing flame and a second ring of ports for inward-facing flame are obtained.

The first injector feeds a C-shaped chamber communicating with an annular chamber obtained in the flame divider by means of three vertical conduits. The second injector feeds a first horizontal Venturi tube communicating with a second vertical Venturi tube leading to a discoid chamber communicating with annular slits of the flame divider for propagation of a stabilization flame.

Such a gas burner presents constructional complexity and is not sufficiently safe because the secondary air used to feed the flame is withdrawn from under the cooktop, with the risk of gas leaks under the cooktop.

Moreover, the route of the primary air/gas mixture from the first injector is rather tortuous, thus generating flame return and instability. For this reason the gas burner needs a stabilization flame.

Another problem is represented by the position of the ignition plug inside the gas burner, which is a constraint for the structure of the gas burner itself.

BRIEF SUMMARY OF THE INVENTION

The purpose of the present invention is to eliminate the drawbacks of the prior art by devising a gas burner with inward-facing flame that is efficient, safe and easy to make and install.

These purposes are achieved according to the invention, with the characteristics claimed in independent claim 1.

Advantageous embodiments appear from the dependent claims.

The gas burner with inward-facing flame of the invention comprises a base body disposed under a cooktop and a disc-shaped lid disposed onto said base body.

The base body comprises:

- a central chamber with cylindrical or truncated-conical shape, connected to at least one horizontal Venturi tube fed by at least one gas injector,
- a peripheral annular chamber, and
- at least two partitions defining at least two apertures providing communication between said central chamber and said peripheral annular chamber.

The lid comprises:

- a central dish disposed onto said central chamber of the base body,
- an intermediate toroidal portion disposed onto said partitions of the base body, and
- a flame ring disposed onto said peripheral annular chamber of the base body, presenting an inclined surface with a plurality of ports communicating with said peripheral annular chamber.

Said ports of the flame ring have an axis inclined upwards and towards the vertical axis of the gas burner for propagation of flame inwards.

The advantages of the gas burner according to the invention are evident, since it has a simple structure, is easy to assemble and gives high flame efficiency, thus reducing the flame diameter.

BRIEF DESCRIPTION OF THE DRAWINGS

Further characteristics of the invention will appear more evident from the detailed description below, which refers to merely illustrative, not limiting embodiments, illustrated in the attached drawings, wherein.

DETAILED DESCRIPTION OF THE INVENTION

Referring to the figures, the gas burner of the invention is disclosed, being generally indicated with numeral (100).

Figure 1:
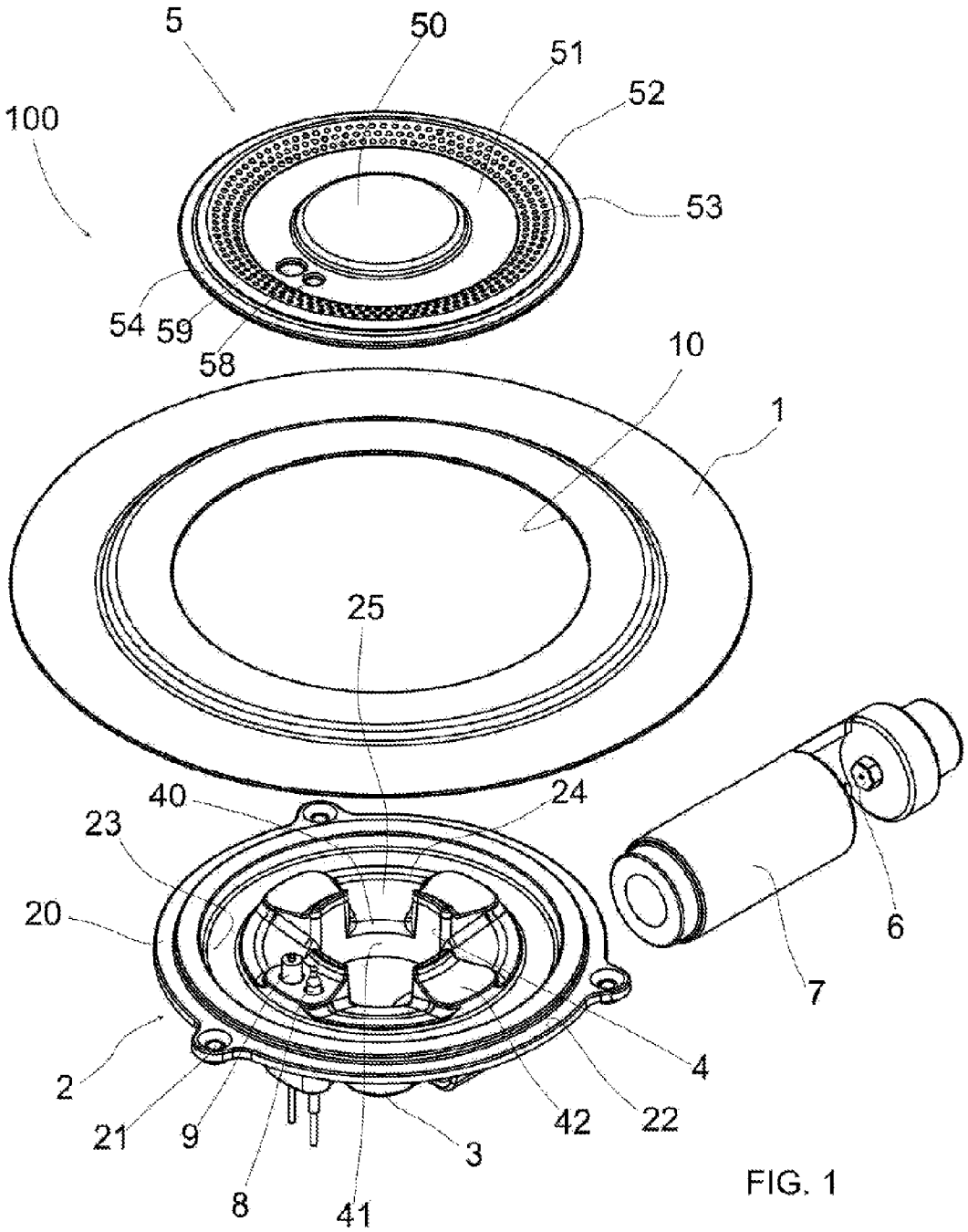
FIG. 1 is an exploded perspective view of the gas burner according to the invention.

Now referring to FIG. 1, a cooktop (1) is disclosed, being provided with a circular hole (10) where the gas burner (100) is mounted.

The gas burner (100) comprises a base body (2) and a cap or lid (5) directly disposed onto the base body. A gas injector (6) is connected to the base body (2) by a Venturi tube (7).

The base body (2) comprises a peripheral annular flange (20) adapted for being fixed to the cooktop (1). To that end, the peripheral flange (20) is provided with holes (21) to receive screw means for fixing to the cooktop.

On the peripheral flange (20) an upward-protruding annular rib (22) is provided to give a support surface for the peripheral part of the upper lid (5). A peripheral annular chamber (23) is obtained on the peripheral flange (20) in recessed position with respect to the peripheral flange, with upper opening.

Figure 6:
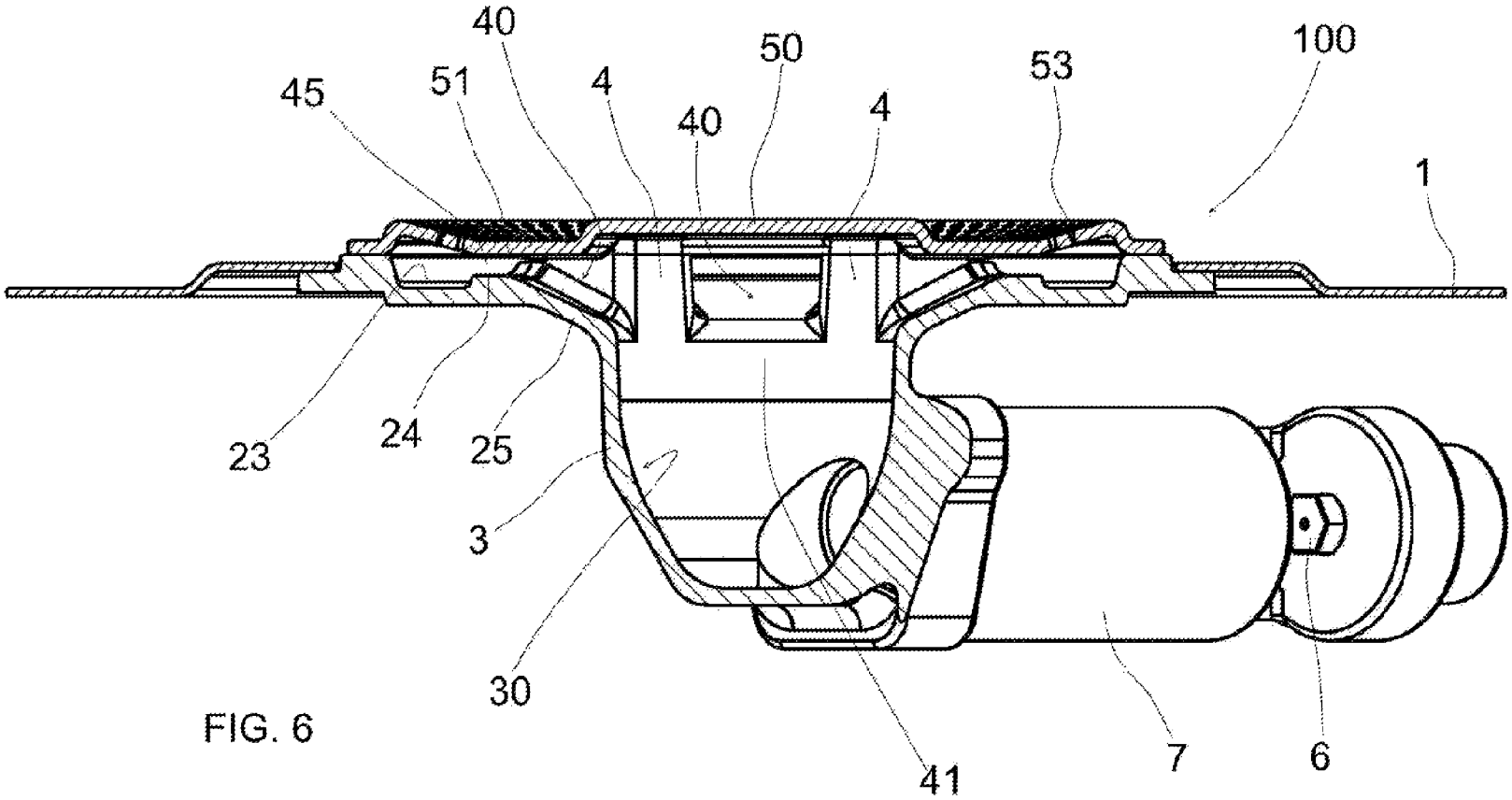
FIG. 6 is a sectional view taken along a different sectional plane compared to FIG. 5.

Referring to FIG. 6, the peripheral annular chamber (23) is provided with an internal circular border (24) that continues towards the interior with a tapered coupling portion (25) with decreasing diameter, from which a central cup (3) protrudes in lower position.

Figure 2:
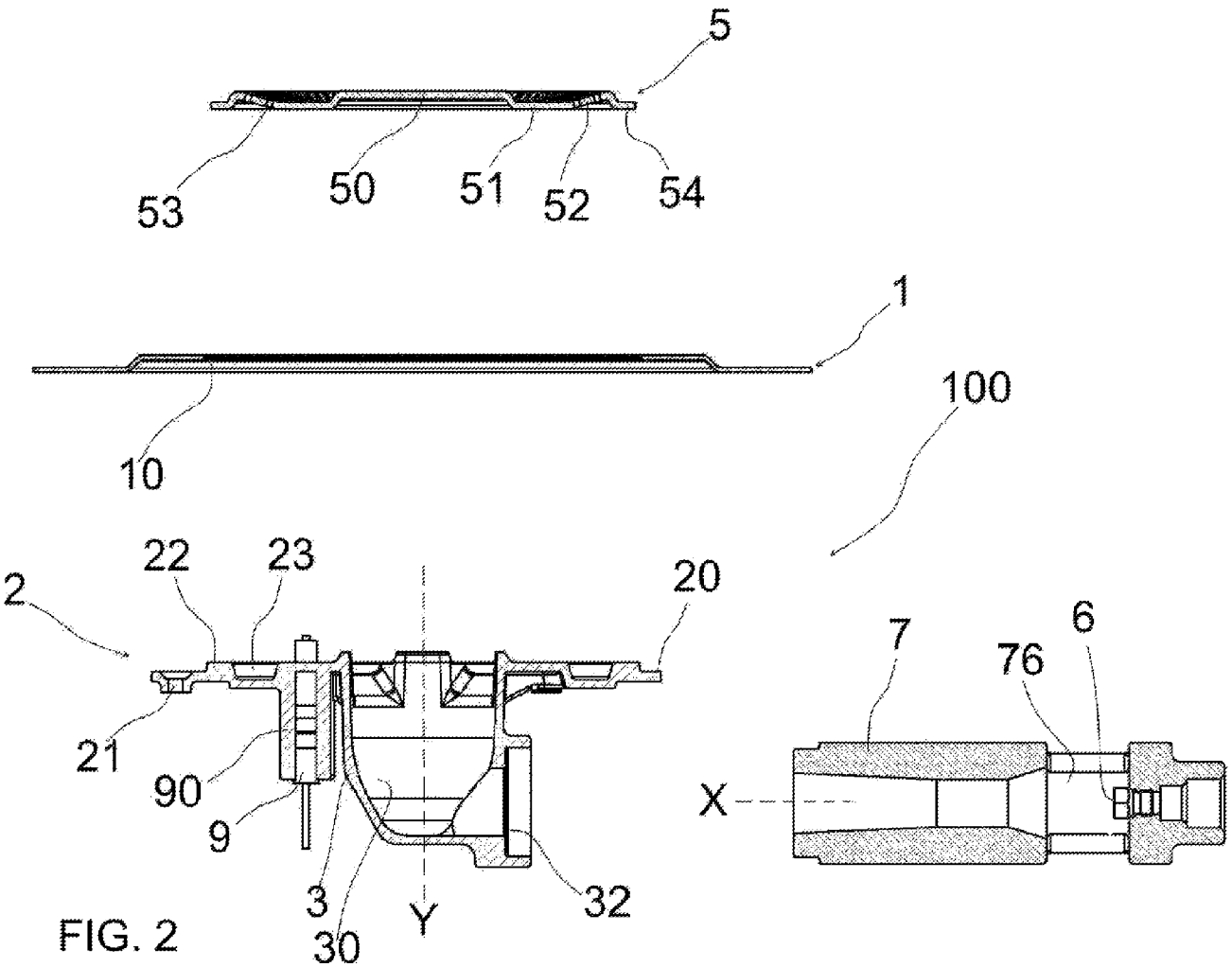
FIG. 2 is a sectional view of the various elements of the gas burner of FIG. 1.
Figure 3:
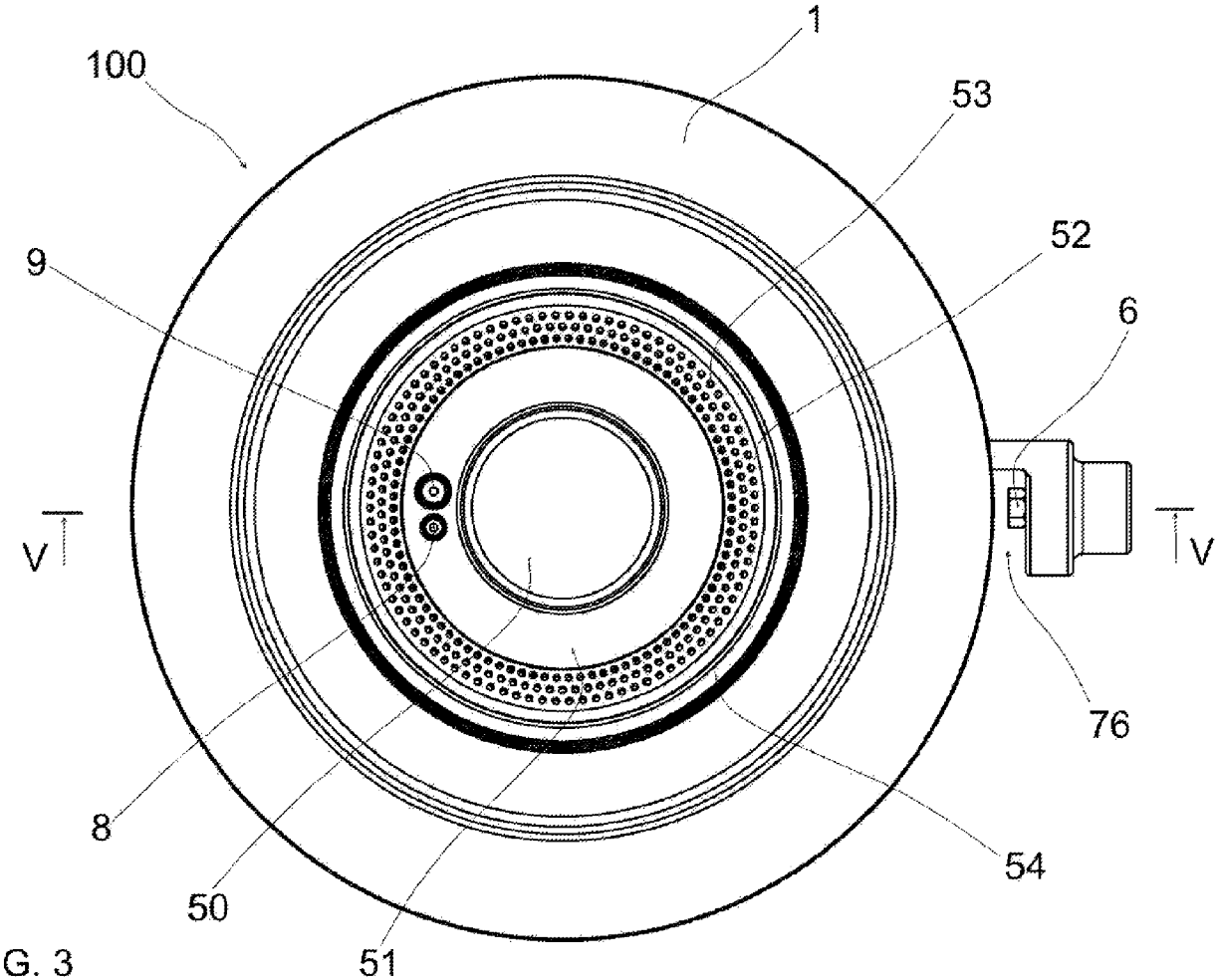
FIG. 3 is a top view of the gas burner of FIG. 1 in assembled condition.
Figure 4:
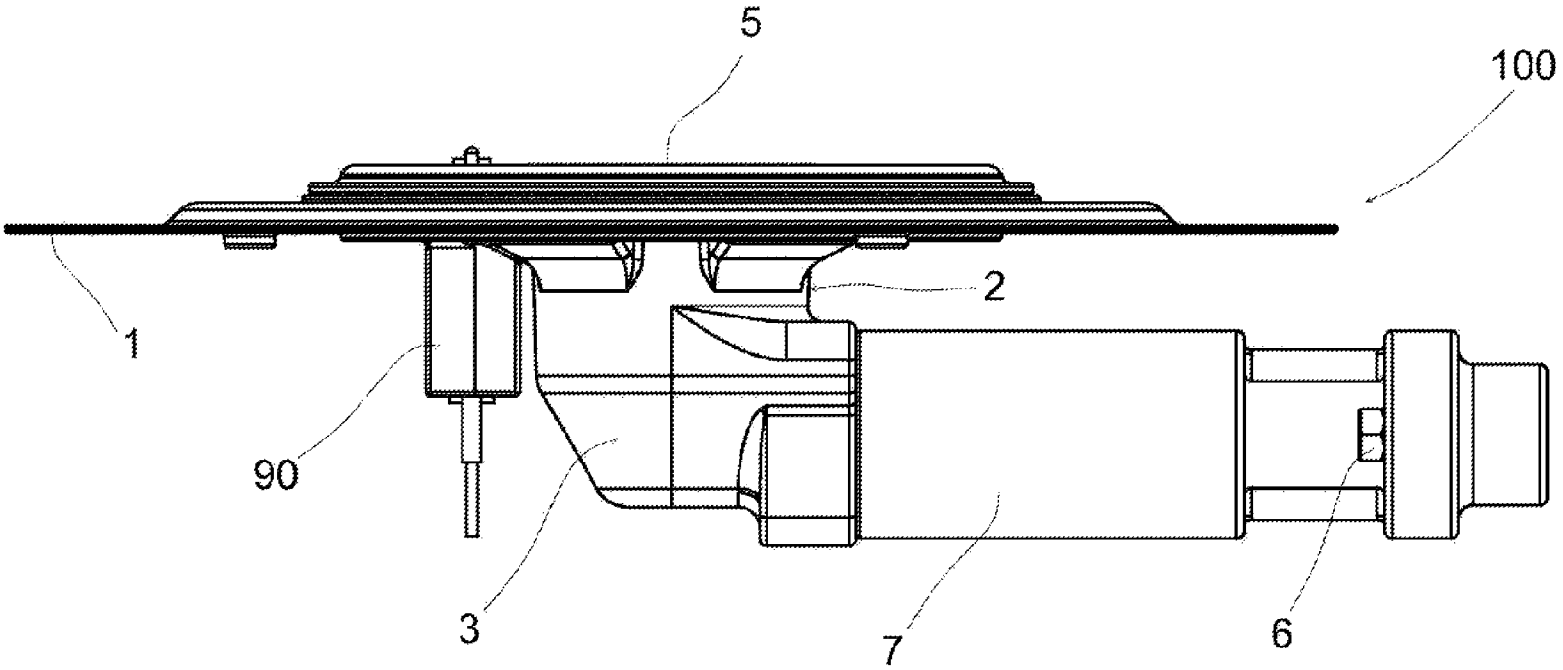
FIG. 4 is a side view of the gas burner of FIG. 1 in assembled condition.

Referring to FIG. 2, the central cup (3) defines a central chamber (30) with cylindrical or truncated-conical shape, having a vertical axis (Y) that coincides with the axis of the gas burner.

The lateral wall of the central cup (3) of the base body is provided with a radial hole (32) coupled with the Venturi tube (7). The Venturi tube (7) presents a cylindrical shape with horizontal axis (X) in radial position with respect to the vertical axis (Y) of the central chamber. Although the figure shows only one injector and only one radial Venturi tube, multiple injectors and multiple horizontal Venturi tubes can be used, also in non-radial arrangement.

Figure 5:
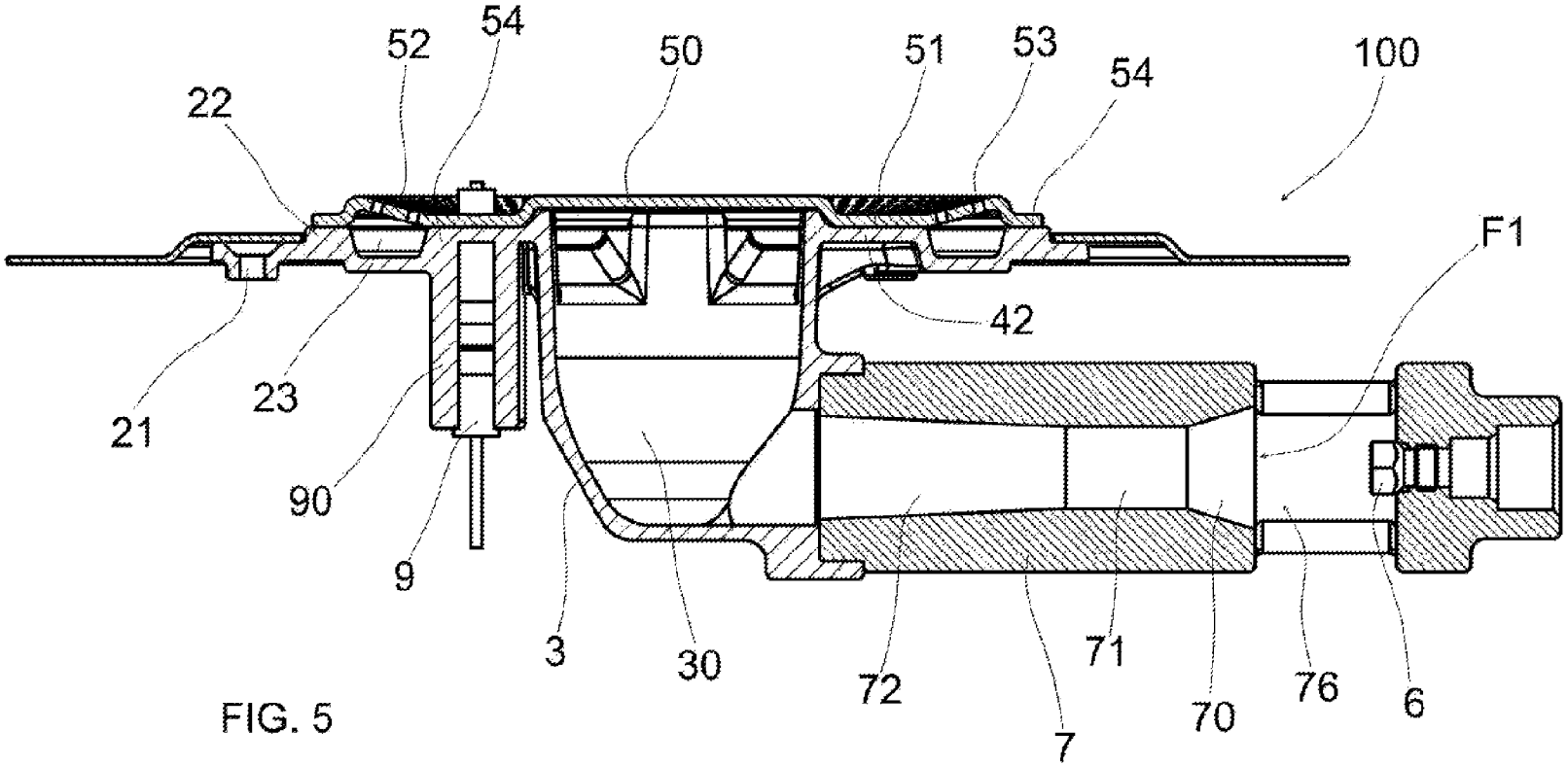
FIG. 5 is a sectional view taken along sectional plane V-V of FIG. 3.

Referring to FIG. 5, the injector (6) overlooks an aperture (76) of the Venturi tube (7) to withdraw primary air entering the Venturi tube (7), because of Venturi effect, according to the flow of the arrow (F1) and mixing with gas coming from the injector (6) to generate an air-gas mixture. The flow of primary air (F1) enters underneath the cooktop (1) and the aperture (76) of the Venturi tube is suitably dimensioned for correct inlet of primary air.

The Venturi tube (7) has a tapered inlet section (70) with decreasing diameter, an intermediate cylindrical section (71) and a tapered outlet section (72) with increasing diameter.

Going back to FIG. 1, four partitions (4) protrude radially inwards from the internal border (24) of the peripheral annular chamber (23), extending upwards on the tapered coupling portion (25). Said partitions (4) define four radial apertures (40) communicating with the peripheral annular chamber (23). In particular, each partition (4) presents a lower end. The lower ends of the partitions (4) are connected by a lower bridge (41) in such manner that each radial aperture (40) has a substantially U-shaped configuration defined between two partitions (4) and the lower bridge (41).

Each partition (4) presents a substantially flat upper surface (42) acting as stop for the upper lid (5). The upper surface (42) is at the same level as the upper surface of the annular rib (22).

Although the figure shows four partitions (4) in diametrally opposite positions defining four apertures (40), at least two partitions (4) can be provided in such manner to generate at least two apertures (40).

One ignition plug (9) and one thermocouple (8) are installed in one partition (4) so that the upper tips of the ignition plug (9) and thermocouple (8) protrude in upper position from the upper surface (42) of the partition. In such a case, a shank (90) is provided under the partition (4), receiving the ignition plug (9) and the thermocouple (8). The shank (90) extends outside the central cup (3).

The position of the thermocouple (8) in the internal part of the burner, with respect to the circular flame ring, allows the thermocouple to have a more accurate detection and a more stable signal, since the circular flame ring acts as barrier for any anomalous air flows coming from outside.

Moreover, the internal position of both elements (ignition plug (9) and thermocouple (8)) guarantees higher protection against shocks during the burner operation.

The lid (5) presents a discoid shape and comprises:

- a central circular dish (50);
- an intermediate toroidal portion (51) in lowered position with respect to the central dish;
- a flame ring (52) with tapered shape and inclined upwards with respect to the intermediate central portion (51),
- a peripheral portion (54) in lowered position with respect to the peripheral border of the flame ring.

The central dish (50) is shaped as a flat discoid plate with diameter substantially equal to the diameter of the central chamber (30) in such manner to be above the central chamber (30).

The intermediate toroidal portion (51) presents a flat lower surface stopped against the flat upper surfaces (42) of the partitions (4) of the base body. Therefore, the intermediate toroidal portion (51) presents two holes (58, 59) to respectively receive the tips of thermocouple (8) and ignition plug (9).

The flame ring (52) is situated onto the peripheral annular chamber (23) and presents a tapered shape with approximately 10°-30° inclination with respect to a horizontal plane. Therefore, a plurality of ports (53) is obtained in the flame ring (52) to propagate the flame. Preferably, three circular rows of ports are provided in such manner to occupy the entire surface of the flame ring (52).

The axis of the ports (53) is inclined inwards with respect to a horizontal plane, with approximately 60°-80° inclination. In view of the above, the flames are directed upwards and towards the interior of the gas burner, namely towards the vertical side of the burner.

The peripheral portion (54) of the upper lid has a flat lower surface stopped against the flat upper surface of the rib (22) of the peripheral flange of the base body, in such way to externally close the peripheral annular chamber (23).

Referring to FIG. 6, it can be noted that the apertures (40) proving communication between central chamber (30) and peripheral annular chamber (23) have a tapered shape with decreasing dimensions from the central chamber (30) to the annular chamber (23). In particular, said apertures (40) present a narrowing (45) between the internal border (24) of the peripheral flange of the base body and the toroidal portion (51) of the upper lid. Said configuration of the apertures (40) is adapted for stabilizing the flow of the air-gas mixture in the annular chamber (23) avoiding flame return from the rings towards the peripheral annular chamber. Said apertures (40) allow for a uniform distribution of the air-gas mixture coming from the central chamber (30) and directed towards the peripheral annular chamber (23). In fact, while ascending from the central chamber, the mixture is partially acquired by the apertures (40) and partially continues its ascending travel towards the lid (5). The part of the mixture ascending and stopping against the central dish (50) of the lid is redistributed in the apertures (40), thus completing the quantity of mixture taken to the peripheral annular chamber (23) by the apertures.

Following is a description of the operation of the gas burner (100) according to the present invention.

The gas injected by the injector (6) is mixed with primary air entering the aperture (76) of the Venturi tube and the air-gas mixture is taken into the Venturi tube (7) by Venturi effect, flowing into the central chamber (30).

The air-gas mixture contained in the central chamber (30) ascends upwards, stopping against the central dish (50) of the upper lid. Therefore, the air-gas mixture enters the apertures (40) and flows in the peripheral annular chamber (23).

The air-gas mixture contained in the peripheral annular chamber (23) leaves the peripheral annular chamber (23) through the ports (53) of the flame ring, generating a flame directed upwards and towards the inside of the burner.

Numerous variations and modifications can be made to the present embodiment of the invention, within the reach of an expert of the field, while still falling within the scope of the invention described in the enclosed claims.

Figure 8:
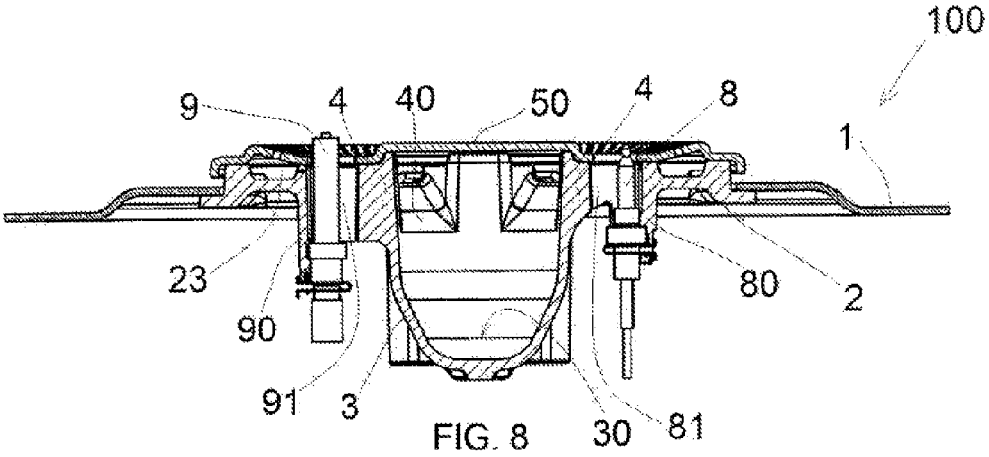
FIG. 8 is a sectional view taken along sectional plane VIII-VIII of FIG. 7.
Figure 7:
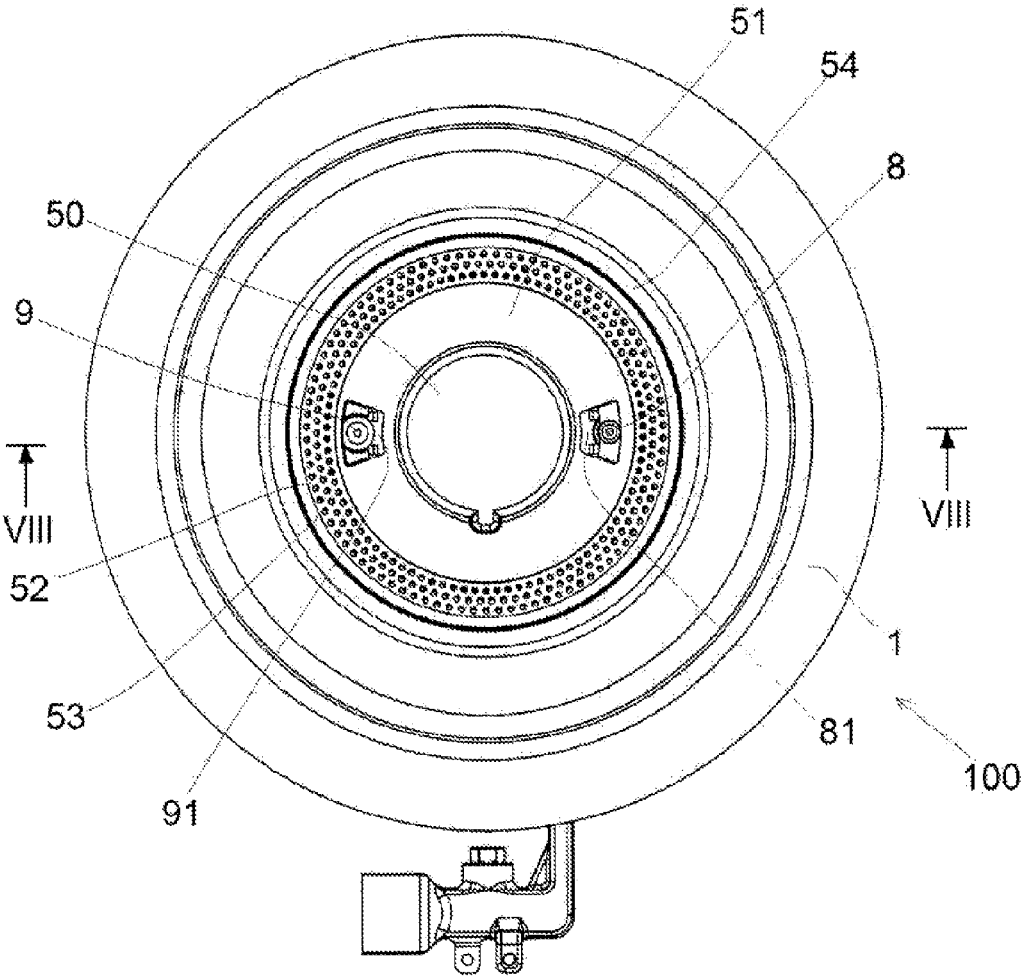
FIG. 7 is a top view of a variant of the gas burner according to the invention.

FIGS. 7 and 8 disclose a variant of the gas burner (100) wherein the ignition plug (9) and the thermocouple (8) are disposed in diametrally opposite positions. The ignition plug (9) and the thermocouple (8) are supported by corresponding shanks (90, 80) extending under partitions (4) of the burner body. Said shanks (90, 80) are situated outside the central cup (3).

The body (2) of the burner is provided with small drain apertures (91, 81) disposed in the proximity of the ignition plug (9) and thermocouple (8) to drain liquids or grease eventually falling on the burner and depositing near the ignition plug (9) and thermocouple (8). In fact, such drain apertures (91, 81) prevent liquids and grease from stagnating around the ignition plug (9) and thermocouple (8), causing the malfunctioning of ignition plug (9) and thermocouple (8).

Evidently, only one drain aperture can be provided for ignition plug (9) and/or thermocouple (8), or a single drain aperture if the ignition plug (9) and thermocouple (8) are disposed in close position, as shown in the embodiment of FIG. 1.

The invention claimed is:

1. A gas burner with inward-facing flame, the gas burner comprising:

a base body adapted for being disposed under a cooktop, said base body comprising:

a central chamber with a cylindrical or truncated-conical shape, said central chamber adapted for being connected to at least one horizontal Venturi tube fed by at least one gas injector;

a peripheral annular chamber; and at least two partitions each defining only one aperture providing communication between said central chamber and said peripheral annular chamber wherein said at least two partitions of said base body have lower ends mutually connected by a bridge in such manner that each of the apertures of the base body has a substantially U-shape defined between an adjacent pair of the partitions and said bridge; and a discoid lid disposed above said base body, said discoid lid comprising:

a central dish disposed onto said central chamber of the said body;

an intermediate portion disposed and in contact with said partitions of the base body; and a flame ring disposed onto said peripheral annular chamber of the base body and presenting an inclined surface a plurality of ports is obtained, said plurality of ports communicating with said peripheral annular chamber, said plurality of ports presenting an axis inclined upwards and inwards towards a central vertical axis of the gas burner for propagation of flame inwardly.

2. The gas burner of claim 1, wherein said base body comprises:

a peripheral annular flange containing said peripheral annular chamber;

a cup containing said central chamber; and a tapered coupling portion that connects said peripheral annular flange with said cup in such manner that said cup protrudes in a lower position with respect to annular peripheral chamber, wherein said at least two partitions are obtained in said tapered coupling portion.

3. The gas burner of claim 1, wherein said at least two partitions of said base body have a substantially flat upper surface on which a flat lower surface of said intermediate portion of the discoidal lid rests.

4. A gas burner with inward-facing flame, the gas burner comprising:

a base body adapted for being disposed under a cooktop and a discoid lid disposed above said base body, said base body comprising:

a central chamber with a cylindrical or truncated-conical shape, said central chamber adapted for being connected to at least one horizontal Venturi tube fed by at least one gas injector; and a peripheral annular chamber; and at least two partitions each defining only one aperture providing communication between said central chamber and said peripheral annular chamber, wherein each of said each aperture has a tapered shape with decreasing dimensions from said central chamber to said peripheral annular chamber; and said discoid lid disposed above said base body, said discoid lid comprising:

a central dish disposed onto said central chamber of the said body;

an intermediate portion disposed onto said partitions of the base body; and a flame ring disposed onto said peripheral annular chamber of the base body and presenting an inclined surface a plurality of ports is obtained, said plurality of ports communicating with said peripheral annular chamber, said plurality of ports presenting an axis inclined upwards and inwards towards a central vertical axis of the gas burner for propagation of flame inwardly.

5. The gas burner of claim 1 wherein the gas burner comprises four partitions defining four apertures in diametrally opposite positions on said base body.

6. The gas burner of claim 1, wherein the gas burner further comprises:

an ignition plug disposed in one of said at least two partitions of the base body in such manner that an upper tip of said ignition plug protrudes in an upper position from the partition and passes through a hole of said intermediate portion of the lid.

7. The gas burner of claim 1, wherein the gas burner further comprises:

a thermocouple disposed in one of said at least two partitions of the base body in such manner that an upper tip of said thermocouple protrudes in an upper position from the partition and passes through a hole of said intermediate portion of the lid.

8. The gas burner of claim 1, wherein the gas burner further comprises:

an ignition plug disposed in one of said at least two partitions of the base body in such manner that an upper tip of the ignition plug protrudes in an upper position from the partition and passes through a hole of said intermediate portion of said discoid lid;

a thermocouple disposed in one of said at least two partitions of the base body in such manner that an upper tip of the thermocouple protrudes in an upper position from the partition and passes through a hole of said intermediate portion of said discoid lid; and wherein said ignition plug and said thermocouple are disposed on the same partition of the base body.

9. The gas burner of claim 1, wherein the gas burner further comprises:

an ignition plug disposed in one of said at least two partitions of the base body in such manner that an upper tip of the ignition plug protrudes in an upper position from the partition and passes through a hole of said intermediate portion of said discoid lid;

a thermocouple disposed in one of said at least two partitions of the base body in such manner that an upper tip of the thermocouple protrudes in an upper position from the partition and passes through a hole of said intermediate portion of said discoid lid; and wherein said ignition plug and said thermocouple-are disposed in a pair of the partitions of the base body in diametrally opposite positions.

10. The gas burner of any of claim 1, wherein the gas burner comprises:

an ignition plug disposed in one of said at least two partitions of the base body in such manner that an upper tip of the ignition plug protrudes in an upper position from the partition and passes through a hole of said intermediate portion of said discoid lid; and a thermocouple disposed in one of said partitions of the base body in such manner that an upper tip of the thermocouple protrudes in an upper position from the partition and passes through a hole of said intermediate portion of said discoid lid; and at least one aperture obtained on said base body in proximity to said ignition plug or said thermocouple to drain liquid or dirt deposited around said ignition plug or said thermocouple.

* * * * *